US008443731B1

(12) United States Patent
Stecher et al.

(10) Patent No.: US 8,443,731 B1
(45) Date of Patent: May 21, 2013

(54) REACTIVE MATERIAL ENHANCED PROJECTILES, DEVICES FOR GENERATING REACTIVE MATERIAL ENHANCED PROJECTILES AND RELATED METHODS

(75) Inventors: Frederick P. Stecher, Corcoran, MN (US); Richard M. Truitt, Champlin, MN (US)

(73) Assignee: Alliant Techsystems Inc., Arlington, VA (US)

( * ) Notice: Subject to any disclaimer, the term of this patent is extended or adjusted under 35 U.S.C. 154(b) by 569 days.

(21) Appl. No.: 12/510,017

(22) Filed: Jul. 27, 2009

(51) Int. Cl.
*F42B 1/028* (2006.01)
*F42B 1/032* (2006.01)
*F42B 12/10* (2006.01)

(52) U.S. Cl.
USPC ..... 102/476; 102/306

(58) Field of Classification Search
USPC ..... 102/476, 306, 307, 308, 309, 310
See application file for complete search history.

(56) References Cited

U.S. PATENT DOCUMENTS 3,135,205 A * 6/1964 Zwicky ..... 102/476
3,235,005 A * 2/1966 Delacour ..... 166/299
3,675,575 A * 7/1972 Bailey et al. ..... 102/306
4,466,353 A 8/1984 Grace
4,590,861 A 5/1986 Bugiel
4,649,828 A 3/1987 Henderson et al.
4,807,795 A 2/1989 LaRocca et al.
5,522,319 A 6/1996 Haselman, Jr.
5,792,977 A 8/1998 Chawla
5,936,184 A * 8/1999 Majerus et al. ..... 89/1.13
5,939,663 A 8/1999 Walters et al.
6,250,229 B1 6/2001 Kerdraon et al.
6,308,634 B1 * 10/2001 Fong ..... 102/476
6,378,438 B1 4/2002 Lussier et al.
6,510,797 B1 1/2003 Fong
6,588,344 B2 7/2003 Clark et al.
6,593,410 B2 7/2003 Nielson et al.
6,868,791 B1 * 3/2005 Thompson et al. ..... 102/476
6,962,634 B2 11/2005 Nielson et al.
7,191,709 B2 3/2007 Nechitailo
7,278,354 B1 10/2007 Langan et al.
7,340,025 B2 3/2008 Melin et al.
7,380,503 B2 6/2008 Williams et al.

(Continued)

OTHER PUBLICATIONS

U.S. Appl. No. 11/512,058, filed Aug. 29, 2006, entitled "Weapons and Weapon Components Incorporating Reactive Materials and Related Methods," by Richard M. Truitt et al.

(Continued)

*Primary Examiner* — James Bergin
(74) *Attorney, Agent, or Firm* — TraskBritt

(57) ABSTRACT

A liner assembly for an explosively formed projectile device may include a reactive material liner and a primary liner configured to form into a projectile responsive to initiation of an explosive material. The reactive material liner may be configured and formulated to increase the velocity of the projectile after formation thereof. An ordnance device for generating an explosively formed projectile may include a case, an explosive material, and a reactive material liner and a primary liner configured, in combination, to form into a projectile. An explosively formed projectile may include a deformed primary liner and a deformed reactive material liner having an ignited portion increasing the velocity of the projectile. Methods of explosively forming a projectile may include explosively expelling a primary liner and a secondary liner and increasing the velocity of the projectile by combusting at least a portion of the secondary liner.

22 Claims, 4 Drawing Sheets

U.S. PATENT DOCUMENTS

| | | | | |
|---|---|---|---|---|
| 7,739,955 | B2 * | 6/2010 | Ronn et al. | 102/476 |
| 2006/0011086 | A1 | 1/2006 | Rose et al. | |
| 2006/0124021 | A1 | 6/2006 | Urwin | |
| 2006/0266551 | A1 | 11/2006 | Yang et al. | |
| 2007/0214991 | A1 | 9/2007 | Ronn et al. | |
| 2007/0272112 | A1 | 11/2007 | Nielson et al. | |
| 2008/0035007 | A1 | 2/2008 | Nielson et al. | |
| 2008/0229963 | A1 | 9/2008 | Nielson et al. | |
| 2009/0071361 | A1 | 3/2009 | Hetz et al. | |
| 2009/0078144 | A1 | 3/2009 | Behrmann et al. | |
| 2009/0078420 | A1 | 3/2009 | Caminari et al. | |

OTHER PUBLICATIONS

U.S. Appl. No. 11/620,205, filed Jan. 5, 2007, entitled "Reactive Compositions Including Metal," by Benjamin N. Ashcroft et al.

U.S. Appl. No. 11/697,005, filed Apr. 5, 2007, entitled "Consumable Reactive Material Fragments, Ordnance Incorporating Structures for Producing the Same, and Methods of Creating the Same," by Daniel B. Neilson et al.

* cited by examiner

REACTIVE MATERIAL ENHANCED PROJECTILES, DEVICES FOR GENERATING REACTIVE MATERIAL ENHANCED PROJECTILES AND RELATED METHODS

TECHNICAL FIELD

Embodiments of the present invention relate generally to explosively formed projectiles. More particularly, embodiments of the present invention relate to explosively formed projectiles, devices for generating explosively formed projectiles including reactive materials and reactive material configurations suitable for increasing the velocity of explosively formed projectiles.

BACKGROUND

Explosively formed projectiles ("EFP") (also known as explosively formed penetrators, and explosively formed perforators) are provided by so-called "shaped charges" that utilize explosive energy to deform a liner disposed over a concave-shaped explosive material into a coherent projectile while simultaneously accelerating it to extremely high velocities. An EFP offers a method of employing a kinetic energy projectile without the use of a large gun. A conventional EFP device is comprised of a metallic liner, a case, an explosive material, and an initiator. The case may also contain a retaining ring to position and hold the liner-explosive subassembly in place. EFP devices are normally designed to produce a single massive, high-velocity projectile that has a high kinetic energy capable of penetrating solid objects, such as, for example, a target in the form of an armored vehicle or a subterranean formation. Upon detonation, the explosive material creates enormous pressures that accelerate the liner while simultaneously reshaping it into a projectile of a rod-like or other desired shape. On impact with a target, the EFP delivers a high mechanical power in an extremely focused manner, enabling penetration of target materials that are impervious to conventional explosives.

The liner of the EFP device is formed from a solid material that is formed into a projectile responsive to detonation of the explosive charge. The liner material is typically a high-density, ductile material, such as a metal, a metal alloy, a ceramic, or a glass. The metals commonly used in liners include iron, copper, aluminum, molybdenum, depleted uranium, tungsten, and tantalum. Depending on the mechanical strength characteristics of the target, penetration by the liner may heavily damage or destroy the target in the vicinity of impaction by the projectile formed from the liner. However, if the target is an armored vehicle or other heavily armored target, the liner may not cause the desired degree of damage. The destructive capability of the EFP may be limited by the geometry and weight of the projectile formed from the liner by the EFP device and the velocity imparted to the projectile by the detonation of the explosive material. Further, aerodynamic drag will generally act to decrease the velocity of projectile as the projectile travels toward the target.

In some applications, in order to improve the destructive capability of the warhead, the liner may be provided with the ability to produce secondary reactions that cause additional damage. These secondary reactions commonly include incendiary reactions. As disclosed in U.S. Pat. No. 4,807,795 to LaRocca et al., pyrophoric metals are added to the liner to provide the desired incendiary effects. In LaRocca et al., a double-layered liner is disclosed, where a layer of dense metal provides the penetration ability and a layer of light metal, such as aluminum or magnesium, produces the incendiary effects.

While metals have been commonly used in liners, reactive materials have also been used. Upon impact with a target, the reactive material of the liner produces a high burst of energy. Such reactive materials for use in penetrating warheads are disclosed, for example, in U.S. Pat. No. 6,962,634, issued Nov. 8, 2005, entitled "Low Temperature, Extrudable, High Density Reactive Materials" and assigned to the assignee of the present invention, the entire disclosure of which patent is incorporated herein by this reference.

BRIEF SUMMARY

In accordance with some embodiments of the present invention, a liner assembly for an explosively formed projectile device may include a reactive material liner comprising a reactive material and a primary liner. The primary liner may be configured to, upon initiation of an explosive material used to form an explosively formed projectile, deform into an outer portion of the projectile at least partially surrounding a portion of the reactive material liner. At least a portion of the reactive material liner may be configured and formulated to increase a velocity of the projectile in excess of a velocity generated by the explosive material.

In additional embodiments, the present invention includes an ordnance device for generating an explosively formed projectile including a case, an explosive material at least partially disposed within the case, a reactive material liner comprising a reactive material at least partially disposed within the case, and a primary liner at least partially disposed within the case and abutting at least a portion of a surface of the reactive material liner. The primary liner may be configured to deform into an outer portion of a projectile at least partially surrounding a portion of the reactive material liner after being expelled from the case responsive to initiation of the explosive material. At least a portion of the reactive material liner may be configured and formulated to increase a velocity of the projectile in excess of a velocity generated by the explosive material.

In yet additional embodiments, the present invention includes an explosively formed projectile including a deformed primary liner substantially forming an outer portion of the projectile and a deformed reactive material liner at least partially disposed within the deformed primary liner. An ignited portion of the deformed reactive material liner may increase a velocity of the projectile in excess of a velocity generated by an explosive material used to form the projectile.

In yet additional embodiments, the present invention includes a method of configuring an explosively formed projectile device including arranging an explosive material at least partially within a case, arranging a reactive material liner at least partially on the explosive material, and arranging a primary liner at least partially on the reactive material liner. The method further includes configuring the primary liner and the reactive material liner to form a explosively formed projectile, configuring and formulating a portion of the reactive material liner to ignite when the reactive material liner is explosively expelled from the case, and configuring the ignited portion of the reactive material liner to increase the velocity of the explosively formed projectile after the forming explosively formed projectile is explosively expelled from the case.

In yet additional embodiments, the present invention includes a method of explosively forming a projectile including explosively expelling a primary liner and a secondary liner from a case, deforming the primary liner to at least partially surround a portion of the secondary liner, and increasing a velocity of the projectile by combusting at least a portion of the secondary liner.

BRIEF DESCRIPTION OF THE SEVERAL VIEWS OF THE DRAWINGS

While the specification concludes with claims particularly pointing out and distinctly claiming that which is regarded as the present invention, the advantages of this invention may be more readily ascertained from the following description of embodiments of the invention when read in conjunction with the accompanying drawings in which:

DETAILED DESCRIPTION

The illustrations presented herein are not meant to be actual views of any particular material, apparatus, system, or method, but are merely idealized representations which are employed to describe embodiments of the present invention. Additionally, elements common between figures may retain the same numerical designation.

Figure 1A:
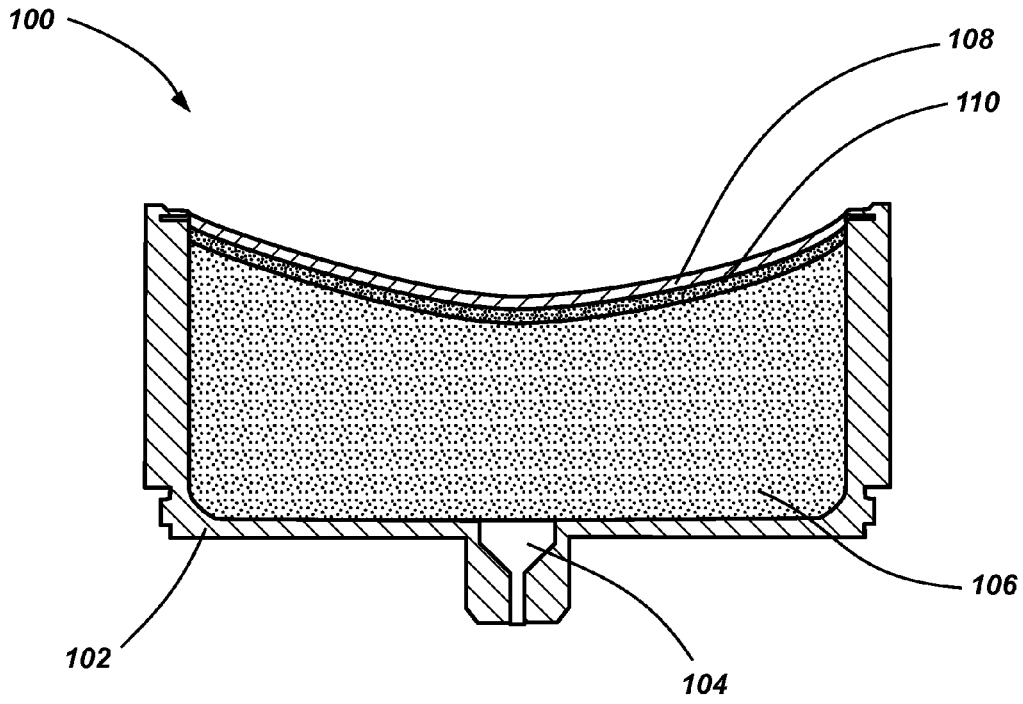
FIGS. 1A and 1B are, respectively, longitudinal cross-sectional views of a device including a reactive material liner in accordance with an embodiment of the present invention for generating an explosively formed projectile and an explosively formed projectile resulting from initiation of the device.

An embodiment of an ordnance device such as a device for generating an EFP, which may be termed an "EFP device" 100 is illustrated in FIG. 1A. The EFP device 100 may include a case 102, an initiator 104, an explosive material 106, and a first liner such as a primary liner 108. In some embodiments, the case 102 may be formed in a shape such as a generally cylindrical tube. Further, the case 102 may be comprised of a material such as steel, a plastic, or a composite material. It is noted that while the case shown in FIG. 1A is formed as a generally cylindrical tube; the case 102 may be formed in other suitable shapes in order to produce the desired shape of the projectile. For example, the case 102 may be formed in a shape such as an elongated rectangular, square, oval, or any other desired shape suitable to produce an explosively formed projectile. As shown in FIG. 1A, the case 102 may have a substantially flat rear surface and walls extending perpendicular to the rear surface. For example, the case 102 may have a substantially hollow cylindrical shape and may have an inside diameter of approximately 1.3 to 16 centimeters (approximately 0.5 to 6 inches). In some embodiments, the case 102 may not have a substantially flat rear surface and may have a non-planar shape such as a concave, convex, or conical shape.

At least a portion of the case 102 may be filled with the explosive material 106. The explosive material 106 may be formed within the interior of the case 102 and may comprise an explosive material 106 such as polymer-bonded explosives ("PBX"), LX-14, C-4, OCTOL, trinitrotoluene ("TNT"); cyclo-1,3,5-trimethylene-2,4,6 trinitramine ("RDX"); cyclotetramethylene tetranitramine ("HMX"); hexanitrohexaazaisowurtzitane ("CL 20"), C-4, combinations thereof, or any other suitable explosive material. In some embodiments, the explosive material 106 may also be formed to have a countersunk recess in a forward surface of the explosive material 106 to receive the placement of a liner or liners. As used herein, the term "forward surface" is meant to describe the surface of the material or liner that faces the open end of the case 102 from which a forming projectile is expelled. The case 102 may also include a detonator such as the initiator 104 located, for example, at the rear surface of the case 102. The initiator 104 may comprise any known detonation device sufficient to detonate the explosive material 106 within the case 102 including, but not limited to, explosives such as pentaerythritol tetranitrate ("PETN"), PBXN-5, CH-6, blasting caps, and electronic detonators (e.g., exploding foil initiators).

As shown in FIG. 1A, the EFP device 100 may include a second or secondary liner such as a reactive material liner 110 that is, for example, formed on the explosive material 106. Depending on the material properties of the composition selected for the reactive material liner 110, the reactive material liner 110 may be formed in a predefined shape by a process such as machining, extrusion, injection molding, etc. The reactive material liner 110 may be formed to substantially fit the shape of the forward surface of the explosive material 106.

In some embodiments, the reactive material liner 110 may include reactive materials including, for example, at least one fuel and, optionally, an oxidizer. In some embodiments, the reactive material utilized in the reactive material liner 110 may include two or more components selected from a fuel, an oxidizer, and a class 1.1 explosive. Binders, polymers, plasticizers, and matrix materials may also be incorporated with various embodiments of the invention as part of the reactive materials or as support structures for the reactive materials. In addition, the reactive material may include an ignition initiator suitable for igniting or initiating combustion of the reactive material.

Fuels that may be used to form reactive materials according to embodiments of the invention may include, but are not limited to, metals, fusible metal alloys, organic fuels, and mixtures thereof. Suitable metals that may be used as fuels in reactive materials include metals such as, for example, hafnium, tantalum, nickel, zinc, tin, silicon, palladium, bismuth, iron, copper, phosphorous, aluminum, tungsten, zirconium, magnesium, boron, titanium, sulfur, magnalium, and mixtures thereof. An organic fuel that may be incorporated into the reactive materials may include, but is not limited to, a mixture of phenolphthalein and hexamine cobalt(III)nitrate (HACN). Fusible metal alloys may include an alloy of a metal selected from the group of gallium, bismuth, lead, tin, cadmium, indium, mercury, antimony, copper, gold, silver, and zinc.

The reactive materials according to embodiments of the invention may also include oxidizers mixed with one or more fuels or with class 1.1 explosives. Oxidizers that may be used to form reactive materials according to embodiments of the invention may include, but are not limited to, inorganic oxidizers, sulfur, fluoropolymers, and mixtures thereof. For example, an oxidizer may include ammonium perchlorate, potassium perchlorate, potassium nitrate, strontium nitrate, basic copper nitrate, ammonium nitrate, cupric oxide, tungsten oxides, silicon dioxide, manganese dioxide, molybdenum trioxide, bismuth oxides, iron oxide, molybdenum trioxide, hafnium oxide, zirconium oxide, polytetrafluoroethylene, thermoplastic terpolymers of tetrafluoroethylene, hexafluoropropylene, vinylidene fluoride (THV), copolymers of vinylidenefluoride-hexafluoropropylene, and mixtures thereof.

The reactive material may, optionally, include a class 1.1, detonable energetic material, such as a nitramine or a nitrocarbon. The energetic material may include, but is not limited to, trinitrotoluene ("TNT"); cyclo-1,3,5-trimethylene-2,4,6 trinitramine ("RDX"); cyclotetramethylene tetranitramine ("HMX"); hexanitrohexaazaisowurtzitane ("CL 20"); 4,10 dinitro 2,6,8,12 tetraoxa 4,10 diazatetracyclo [5.5.0.0 5,9.0 3,11] dodecane ("TEX"); 1,3,3 trinitroazetine ("TNAZ"); ammonium dinitramide ("ADN"); 2,4,6 trinitro 1,3,5 benzenetriamine ("TATB"); dinitrotoluene ("DNT"); dinitroanisole ("DNAN"); or combinations thereof.

Reactive materials according to embodiments of the invention may also include binder materials. The binder, if present, may be a curable organic binder, a thermoplastic fluorinated binder, a non-fluorinated organic binder, a fusible metal alloy, an epoxy resin, silicone, nylon, or combinations thereof. The binder may be a high-strength, inert material including, but not limited to, polyurethane, epoxy, silicone, or a fluoropolymer. Alternatively, the binder may be an energetic material, such as glycidyl azide polymer ("GAP") polyol. The binder may enable the reactive material to be pressed, cast, or extruded into a desired shape. The thermoplastic fluorinated binder may include, but is not limited to, polytetrafluoroethylene ("PTFE"); a thermoplastic terpolymer of tetrafluoroethylene, hexafluoropropylene, and vinylidene fluoride ("THV"); perfluorosuccinyl polyether di-alcohol; a fluoroelastomer; or combinations thereof.

The reactive materials used according to embodiments of the invention may, optionally, include ignition initiators, which are suitable for igniting the reactive materials after the reactive material liner 110 has been explosively expelled from the case 102. The ignition initiators may be formed or mixed with the reactive materials or may be a distinct, separate material from the reactive material. The ignition initiator may be optional because the reactive material may ignite on launch due to external forces such as an explosive shockwave formed by the detonation of the explosive material 106 or the reactive material may ignite due to aerodynamic heating of the reactive material in contact with air. Ignition initiators according to embodiments of the invention include materials that are capable of producing sufficient thermal activity to ignite the reactive materials. For example, the ignition initiators may include reactive powders, electrical wires, or reactive foils. Ignition initiators incorporated with a reactive material of particular embodiments of the invention may be activated, releasing thermal energy which ignites the reactive materials.

In other embodiments of the invention, an ignition initiator is mixed or blended with a reactive material. For example, a reactive powder suitable as an ignition initiator may be mixed with components used to form a reactive material, such as with a fuel or oxidizer. Examples of reactive powders suitable as ignition initiators include a metal powder in combination with an oxidizer. The metal powder may include, but is not limited to, zirconium, aluminum, hafnium, titanium, nickel, iron, boron, silicon, tin, zinc, tungsten, copper, or combinations thereof. The oxidizer may be potassium perchlorate, potassium nitrate, bismuth oxide, hafnium oxide, iron oxide, an alkali metal nitrate, a fluoropolymer, or combinations thereof. Each of the metal powder and the oxidizer may have a small particle size, such as less than approximately 20 μm. If faster rates of reactions or burn rates are desired, the metal powder and the oxidizer may have a particle size on the order of several nanometers.

Other reactive materials, binders, polymers, plasticizers, and ignition initiators that may be incorporated with the reactive materials according to embodiments of the invention may include those materials disclosed in the following United States Patents and Patent Applications, the disclosure of each of which is incorporated herein by reference in its entirety: U.S. Pat. No. 6,593,410; U.S. Pat. No. 6,962,634; U.S. patent application Ser. No. 11/079,925, entitled "Reactive Material Enhanced Projectiles and Related Methods," filed Mar. 14, 2005, now U.S. Pat. No. 7,603,951, issued Oct. 20, 2009; U.S. patent application Ser. No. 11/538,763, entitled "Reactive Material Enhanced Projectiles and Related Methods," filed Oct. 4, 2006; U.S. patent application Ser. No. 11/512,058, entitled "Weapons and Weapon Components Incorporating Reactive Materials and Related Methods," filed Aug. 29, 2006, now U.S. Pat. No. 7,614,348, issued Nov. 10, 2009; U.S. patent application Ser. No. 11/620,205, entitled "Reactive Compositions Including Metal" filed on Jan. 5, 2007; U.S. patent application Ser. No. 11/690,016, entitled "Reactive Material Compositions, Shot Shells Including Reactive Materials, and A Method Of Producing Same," filed Mar. 22, 2007; U.S. patent application Ser. No. 11/697,005, entitled "Consumable Reactive Material Fragments, Ordnance Incorporating Structures for Producing the Same, and Methods of Creating the Same," filed Apr. 5, 2007; and U.S. patent application Ser. No. 12/127,627, entitled "Reactive Material Enhanced Munition Compositions and Projectiles Containing Same" filed on May 27, 2008.

Referring again to FIG. 1A, the EFP device may include a primary liner 108 formed from one or more materials such as a metal, a metal alloy, a ceramic, or a glass. The metal and metal alloy materials may include materials such as iron, copper, steel, aluminum, molybdenum, tungsten, tantalum, etc. Further, the primary liner 108 may also be formed from reactive materials such as the reactive materials previously described in reference to the reactive material liner 110. Similar to the reactive material liner 110, the primary liner 108 may be formed in a predefined shape in order to substantially fit the shape of an adjacent surface such as the forward surface of the reactive material liner 110. It is noted that while the embodiment shown in FIG. 1A details a primary liner 108 and a reactive material liner 110 having a substantially curved shape (e.g., a concave shape, a conical shape, etc.), the primary liner 108, the reactive material liner 110, and the explosive material 106 may be formed in other shapes such as a disc shapes, convex shapes, tapered shapes, cones, spheres, hemispheres, cylinders, tubes, lines, L-beams, etc. As may be appreciated by one of ordinary skill in the art, the shape of the case 102, explosive material 106, and liner or liners (e.g., the primary liner 108 and the reactive material liner 110 shown in FIG. 1A) may be utilized to determine the shape of the projectile 101 (FIG. 1B) produced by the EFP device 100. It is further noted, that the various liners are described herein as being formed in layers on the explosive material 106 to illustrate the different liners in the EFP device 100 and such a process is not meant as a limitation. It is contemplated by the current invention that the liners may be formed by processes such as, for example, forming the liners together in a laminate structure which is then disposed on the explosive material, forming the liners and the explosive material and then disposing the liners and explosive material in the case, or injection molding a liner or liners between other liners or the explosive material.

In some embodiments, the thickness of the liners 108 and 110 may be utilized to determine the geometry and size and the projectile 101 (FIG. 1B) produced by the EFP device 100. The primary liner 108 may have a thickness, for example, measuring 0.75 to 2.00 mm (approximately 0.03 to 0.08 inch) and the reactive material liner 110 may have a thickness, for example, measuring 1.25 to 3.80 mm (approximately 0.05 to 0.15 inch). In some embodiments, the primary liner 108 and the reactive material liner 110 may have a substantially consistent thickness throughout the liner. In other embodiments, the thickness of the liners 108 and 110 may vary throughout the liners and the liners 108 and 110 may also contain protrusions and cavities through the liners in order to produce the desired geometry of the explosively formed projectile 101 upon expulsion of the forming projectile 101 from the case 102.

In order to retain the explosive material 106 and the primary liner 108 and the reactive material liner 110 at least partially within the case 102, the explosive material 106, the primary liner 108, and the reactive material liner 110 may be mounted together physically, for example, by a retaining ring disposed around and fixed to the open end of the case 102. In some embodiments, the explosive material 106, the primary liner 108, and the reactive material liner 110 may be held together by an adhesive, by another mechanical attachment, or by a combination of adhesive and mechanical attachments.

Figure 1B:
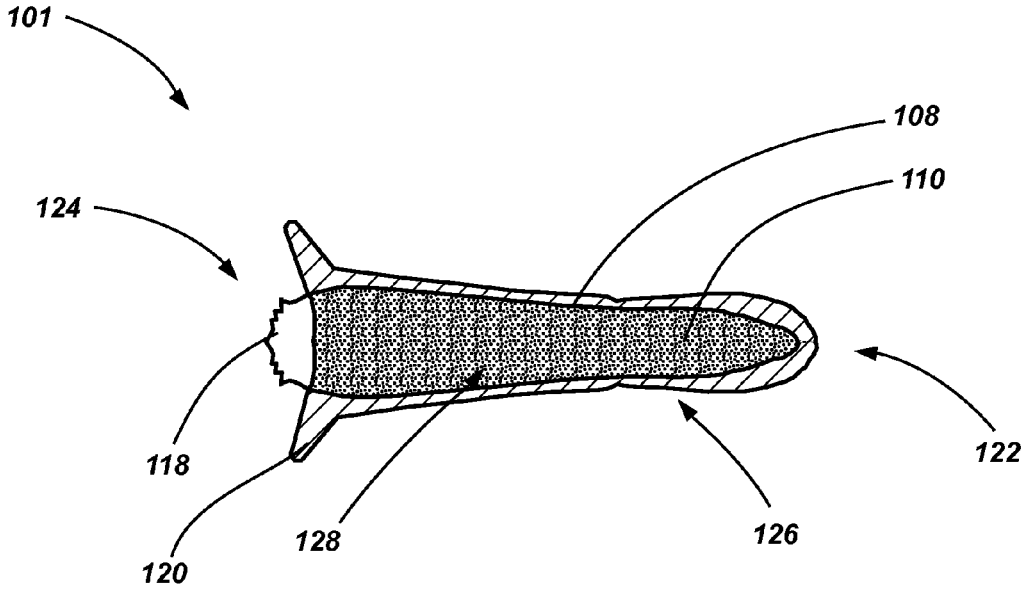

Referring now to FIGS. 1A and 1B, when the explosive material 106 in the EFP device 100 is detonated, the primary liner 108 and the reactive material liner 110 form a projectile 101 that has a high kinetic energy capable of penetrating solid objects, such as a target. In order to expel the primary liner 108 and the reactive material liner 110 from the case 102, the explosive material 106 may be detonated by the initiator 104. A high-pressure (e.g., 100 to 400 kilobars) detonation shockwave is generated by the rapidly combusting explosive material. The high-pressure explosive gases behind the detonation shockwave impart energy and projectile formation forces to the primary liner 108 and the reactive material liner 110. The shockwave created by detonation of the explosive material 106 may propagate radially or linearly through the EFP device 100 from the initiator 104 toward the open end of the case 102. In some embodiments, the primary liner 108 and the reactive material liner 110 may be formed (e.g., contoured) to substantially cover the explosive material 106 on a forward surface of the explosive material 106 (i.e., the surface of the explosive material 106 not encompassed by the case 102). For example, the reactive material liner 110 may be formed to cover the forward surface of the explosive material 106 in order to increase the amount of pressure volume energy delivered to the reactive material liner 110. The case 102 will tend to direct the pressure volume energy generated by ignition of the explosive material 106 through the open end of the case 102, thereby, imparting a substantial amount of the pressure volume energy produced by this ignition to the reactive material liner 110 and the primary liner 108 formed on the reactive material liner 110. The pressure volume energy delivered to the primary liner 108 and the reactive material liner 110 simultaneously deforms the primary liner 108 and the reactive material liner 110 into a projectile 101 and propels the forming projectile 101 at a velocity from the case 102.

An example of a projectile 101 formed by the EFP device 100 is shown in FIG. 1B. As discussed above, the size and geometry of the projectile 101 may be dictated by the liners 108 and 110 formed in the case 102 and the pressure volume energy delivered to the liners 108 and 110 by the explosive material 106. Therefore, it is noted that size and geometry of the projectile 101 shown in FIG. 1B is to illustrate the present embodiment of the invention and is not a limitation.

The pressure volume energy delivered to the primary liner 108 and the reactive material liner 110 deforms the liners 108 and 110 into a projectile shape such as the substantially elongated shape shown in FIG. 1B. In some embodiments, the primary liner 108 may be deformed into an outer portion 126 of the substantially concave projectile 101 and may partially surround the reactive material liner 110. In some embodiments, the primary liner 108 may partially surround the reactive material liner 110. The primary liner 108 may deform to substantially form the anterior portion 122 (taken in the direction of projectile travel) of the projectile 101 and the reactive material liner 110 may deform into a central portion 128 of the projectile 101. The primary liner 108 may deform to extend longitudinally along the projectile 101 and a portion of the deformed reactive material liner 110 may be exposed at the posterior portion 124 (taken in the direction of projectile travel) of the projectile 101. In some embodiments, the reactive material liner 110 may comprise a material having a lower dynamic plastic flow strength than that of the primary liner 108 in order to deform into the central portion 128 of the projectile 101 while being substantially surrounded by the deformed primary liner 108. Additionally, the primary liner 108 may be deformed to provide flanges 120 on the posterior portion 124 of the projectile 101. The flanges 120 may extend in an outward direction from a longitudinal axis of the projectile 101 and may be formed to enhance the aerodynamic properties of the projectile 101, such as by providing increased aerodynamic stability of the projectile 101 during flight. It is noted that while the embodiment shown in FIG. 1B is directed at a projectile 101 with the reactive material liner 110 deformed to be substantially disposed in a central portion 128 of the projectile 101 substantially surrounded by the primary liner 101, the reactive material liner 110 may be formed in additional configurations based on the relative amounts of liner material used for liners 108 and 110, the shapes of the liners, the case, and the explosive material. For example, the reactive material liner 110 may be disposed between two separate liners similar to the primary liner 108 such that a projectile is formed having a reactive material liner formed in a space between the two primary liners.

In some embodiments, the reactive material liner 110 may also be ignited as the primary liner 108 and the reactive material liner 110 are expelled from the case 102. For example, the reactive material liner 110 may be ignited by the shockwave created by the detonation of the explosive material 106. As the projectile 101 is formed, the reactive material liner 110 may start to combust. As discussed above, the reactive material utilized in the reactive material liner 110 may be formulated to provide a desired rate of reaction or "burn rate" and may also, in some embodiments, contain an ignition initiator to facilitate the ignition of the reactive material. The combustion of the reactive material liner 110 may form a propellant generated thrust such as a propulsive jet 118 shown in FIG. 1B. For example, as the projectile 101 completes formation, a portion of the reactive material liner 110 is ignited. The ignition of the reactive material liner 110 produces a reaction force such as the thrust generated by the propulsive jet 118 in a direction substantially opposite to the direction in which the projectile 101 is propelled by the explosive material 106. In some embodiments, the primary liner 108 may form at least partially around the posterior portion 124 of the projectile 101. The deformed primary liner 108 may reduce the flow rate and thrust from the reactive material liner 110 ignited by the shockwave impulse and may decrease the size of the propulsive jet 118 formed by the combustion of the reactive material of the reactive material liner 110 at the posterior portion 124 of the projectile 101.

The thrust produced by the reactive material in the reactive material liner 110 may increase the velocity of the projectile 101 during the tight of the projectile 101 after it has been expelled from the case 102 at an initial velocity and before the projectile 101 impacts a target. For example, an EFP device 100 may be formed to produce a projectile 101 having an initial velocity of 2.2 km/s. That is, the ignition of the explosive material 106 may form a projectile 101 from the primary liner 108 and the reactive material liner 110 and propel the liners 108 and 110 toward a target at an initial velocity of 2.2 km/s. As will be appreciated by one with ordinary skill in the art, aerodynamic drag will reduce the initial velocity of the projectile 101 as the projectile 101 travels toward the target. In some embodiments, the thrust produced by the ignition of the reactive material may increase the velocity of projectile 101 ten to forty percent (10% to 40%) higher than the initial velocity provided by the pressure volume energy imparted to liners 108 and 110. By way of example and not limitation, the ignition of the reactive material liner 110 may further increase the velocity of the explosively formed projectile 101 to a velocity of 2.75 km/s (i.e., approximately a 25% increase in velocity). The higher velocity of the projectile 101 may increase the range and destructive capability of the projectile 101 such as perforation capability and behind-armor debris effects. Additionally, upon impact with the target, any reactive material of the reactive material liner 110 that has not been burned to propel the projectile 101 may produce a high burst of energy, further increasing the destructive capability of the projectile 101. It is noted that while the embodiment shown and described with reference to FIGS. 1A and 1B illustrates a projectile 101 having a primary liner 108 forming an anterior portion 122 of the projectile 101, the primary liner 108 may form a posterior portion 124 of the projectile 101. For example, in a forward folding explosively formed projectile, the primary liner may be disposed on the forward surface of the explosive material and the reactive material liner may be disposed on the forward surface of the primary liner. After initiation of the explosive material, the primary liner may form a posterior portion of the projectile and a propulsive jet of the reactive material liner may be formed through a hole in the primary liner.

Figure 2A:
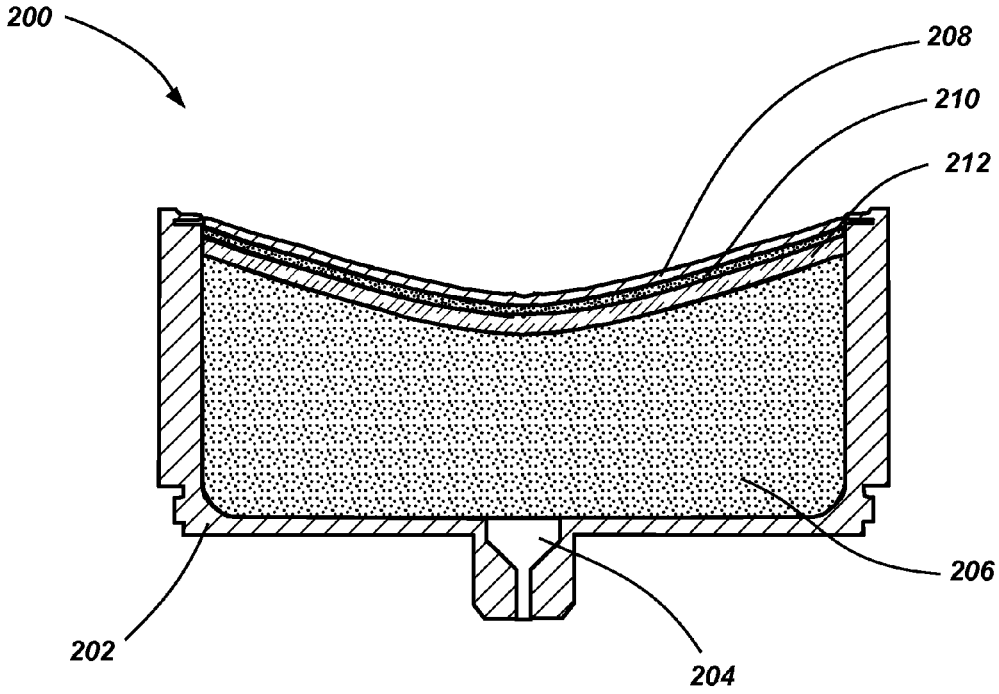
FIGS. 2A and 2B are, respectively, longitudinal cross-sectional views of an another embodiment of a device including a reactive material liner and a control liner for generating an explosively formed projectile and an explosively formed projectile resulting from initiation of the device.
Figure 2B:
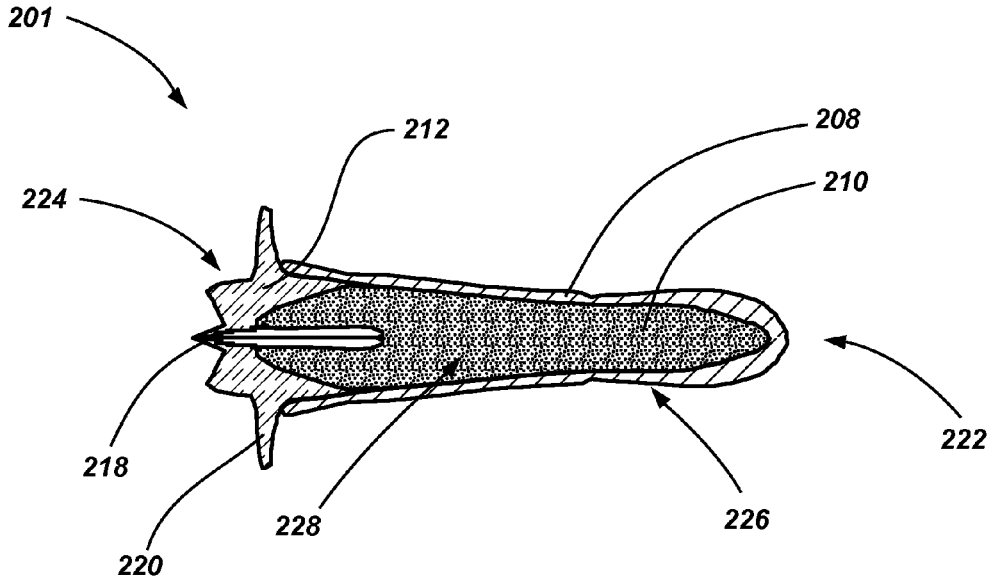

An additional embodiment of the present invention is shown in FIGS. 2A and 2B. The EFP device 200 shown in FIG. 2A is substantially similar to the EFP device 100 previously described with reference to FIG. 1A, and may include a case 202, an initiator 204, an explosive material 206, and a primary liner 208. The case 202, initiator 204, explosive material 206, and primary liner 208 may comprise similar materials and configurations as discussed above in reference to the EFP device 100. The EFP device 200 may also comprise a second liner such as a reactive material liner 210 similar to the above described reactive material liner 110. The EFP device 200 may further include a third, control liner 212 comprising a control material. The control liner 212 may comprise a material configured and formulated to control (i.e., enhancing or impeding) the rate of reaction of the reactive material liner 210. For example, the control liner 212 may be formed on the forward surface of the explosive material 206 and may comprise a material such as a polymer, metal, metal alloy, ceramics, etc. The polymer materials may include polymethylmethacrylate (PMMA), acrylonitrile butadiene styrene (ABS), polybutylene terephthalate (PBT), a photopolymer, etc. The metal materials may include copper, steel, aluminum, etc. that are nonporous and porous. The ceramics may include boron carbide, alumina, tungsten carbide, etc. In some embodiments, the control liner 212 may comprise a substantially inert material that may tend not to react with the reactive material liner 210. In some embodiments, control liner 212 may comprise a material that may react with the combusting explosive material 206. The control liner 210 may have a thickness, for example, measuring 2.54 mm (approximately 0.10 inch).

As shown in FIG. 2B, the pressure volume energy delivered to the primary liner 208, the reactive material liner 210, and the control liner 212 may deform the liners 208, 210, and 212 into a projectile shape such as a substantially elongated shape. In some embodiments, the primary liner 208 may be deformed into an outer portion 226 of the substantially elongated projectile 201 and may at least partially surround the reactive material liner 210 and the control liner 212. The primary liner 208 may deform to substantially form the anterior portion 222 (taken in the direction of projectile travel) of the projectile 201 and the reactive material liner 210 and the control liner 212 may deform into a central portion 228 of the projectile 201. In some embodiments, a portion of the reactive material liner 210 may be exposed at the posterior portion 224 of the projectile 201. In some embodiments, the reactive material liner 210 and the control liner 212 may comprise materials having a lower dynamic plastic flow strength than that of the primary liner 208 in order to deform into the central portion 228 of the projectile 201 substantially surrounded by the deformed primary liner 208. Additionally, the primary liner 208, the control liner 212, or both the primary liner 208, the control liner 212 may be deformed to provide flanges 220 on the posterior portion 224 of the projectile 201.

Similar in manner to performance of the previously described EFP device 100, the reactive material liner 210 may also be ignited as the primary liner 208, the reactive material liner 210, and the control liner 212 are expelled from the case 202. In some embodiments, the control liner 212 may control the rate of reaction of the reactive material in the reactive material liner 210. For example, the control liner 212 may mitigate or reduce the shock pressure imparted to reactive material liner 210 from the detonation of explosive material 206 and may decrease the combustion rate of the reactive material ignited by the shockwave impulse. In some embodiments, the control liner 212 may decrease the size of a propulsive jet 218 formed by the combustion of the reactive material of the reactive material liner 210 at the posterior portion 224 of the projectile 210. The shape, size, and thickness of the control liner 212 formed in the case 201 may be varied to control the size of the propulsive jet 218 of the projectile 201 and produce the desired velocity increase provided by the ignited reactive material following the formation of the projectile 201.

Figure 3A:
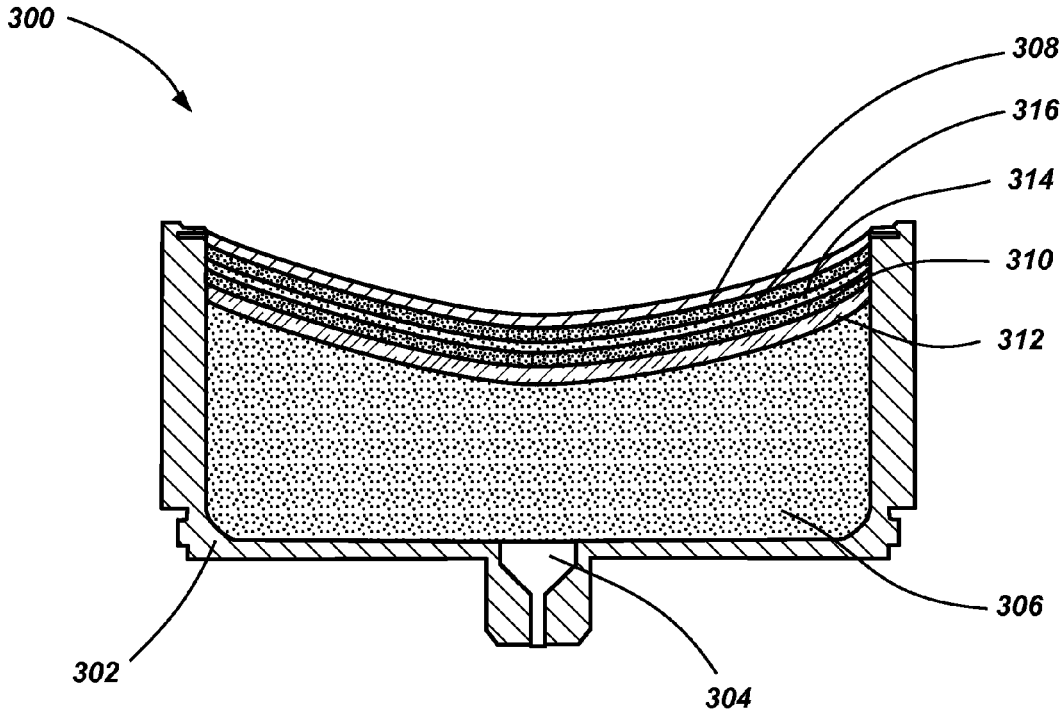
FIGS. 3A and 3B are, respectively, longitudinal cross-sectional views of an another embodiment of a device including a reactive material liner, a buffer liner, an additional reactive material liner, and a control liner for generating an explosively formed projectile and an explosively formed projectile resulting from initiation of the device.
Figure 3B:
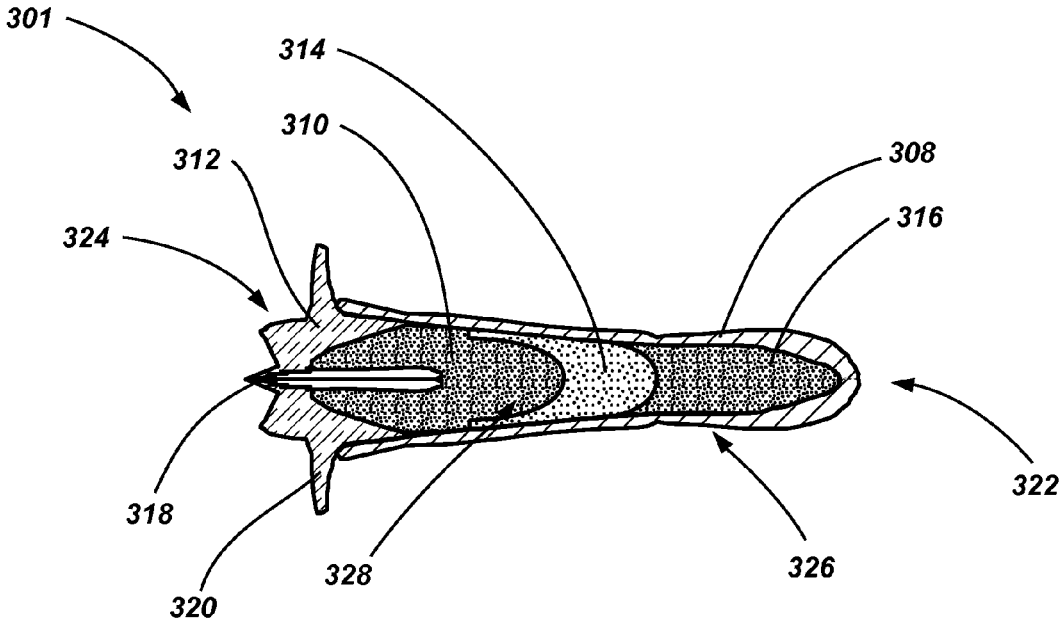

An additional embodiment of the present invention is shown in FIGS. 3A and 3B. The EFP device 300 shown in FIG. 3A is substantially similar to the EFP devices 100 and 200 previously described with reference to FIGS. 1A and 2A, respectively, and may include a case 302, an initiator 304, an explosive material 306, and a primary liner 308. The case 302, initiator 304, explosive material 306, and primary liner 308 may comprise similar materials and configurations as discussed above in reference to the EFP devices 100 and 200. The EFP device 300 may also include a second liner such as a reactive material liner 310 and a control liner 312 similar to the reactive material liners 110 and 210 previously described with reference to FIGS. 1A and 2A and the control liner 212 described with reference to FIG. 2A.

The EFP device 300 may further include a fourth liner comprising an additional reactive material and a fifth, buffer liner 314 comprising a buffer material. The buffer liner 314 may comprise a material configured and formulated to separate the reactive material liner 310 and the additional reactive material liner 316. The buffer liner 314 may be formed in between the reactive material liner 310 from the additional reactive material liner 316 in the case 302. The buffer liner 314 may comprise a material such as a polymer, metal, metal alloy, ceramic, etc. In some embodiments, the buffer liner 314 may comprise a substantially inert material that will tend to not react with the reactive material liner 310. The reactive material liner 310 and the additional reactive material liner 316 may comprise the same reactive material or the reactive material liner 310 may comprise a first reactive material composition while the additional reactive material liner 316 comprises a different second reactive material composition. The additional reactive material liner 316 may comprise materials similar to the reactive material liners 110 and 210 previously described with reference to FIGS. 1A and 2A.

As shown in FIG. 3B, the pressure volume energy delivered to the primary liner 308, the reactive material liner 310, the buffer liner 314, the additional reactive material liner 316, and the control liner 312 by the explosive material 306 deforms the liners 308, 310, 312, 314, and 316 into a projectile shape such as a substantially elongated shape. In some embodiments, the primary liner 308 may be deformed into an outer portion 326 of a substantially concave projectile 301 and may at least partially surround the reactive material liner 310, the buffer liner 314, the additional reactive material liner 316, and the control liner 312. The primary liner 308 may deform to substantially form the anterior portion 322 (taken in the direction of projectile travel) of the projectile 301 and the reactive material liner 310, the buffer liner 314, and the additional reactive material liner 316 may deform into a central portion 328 of the projectile 301. The control liner 312 may be substantially disposed at the posterior portion 324 of the projectile 301. The buffer liner 314 may be disposed between the reactive material liner 310 and the additional reactive material liner 316. In some embodiments, a portion of the reactive material liner 310 may be exposed at the posterior portion 324 of the projectile 301 to form propulsive jet 318. In some embodiments, the reactive material liner 310, the buffer liner 314, the additional reactive material liner 316, and the control liner 312 may comprise materials having a lower dynamic plastic flow strength than that of the primary liner 308 in order to deform into the central portion 328 of the projectile 301 substantially surrounded by the deformed primary liner 308. Additionally, the primary liner 308, the control liner 312, or both the primary liner 308, the control liner 312 may be deformed to provide flanges 320 on the posterior portion of the projectile 301.

In a manner similar to the actuation of the EFP assemblies 100 and 200, previously described with reference to FIGS. 1A and 2A, respectively, the reactive material liner 310 may be ignited as the reactive material liner 310, the buffer liner 314, the additional reactive material liner 316, and the control liner 312 are expelled from the case 302. The buffer liner 314 may act to buffer the additional reactive material liner 316 from the reactive material liner 310. The separation of the reactive material liner 310 from the additional reactive material liner 316 allows the reactive material liner 310 to be ignited in order to increase the velocity of the projectile 301 after being explosively expelled from the case 302. The buffer liner 314 acts to inhibit the additional reactive material liner 316 from igniting during the formation of the projectile 301. The unspent reactive material of both the reactive material liner 310 and the additional reactive material liner 316 may produce a high burst of energy both thermal and mechanical further increasing the destructive capability of the projectile 301 upon impact with the target.

Figure 4A:
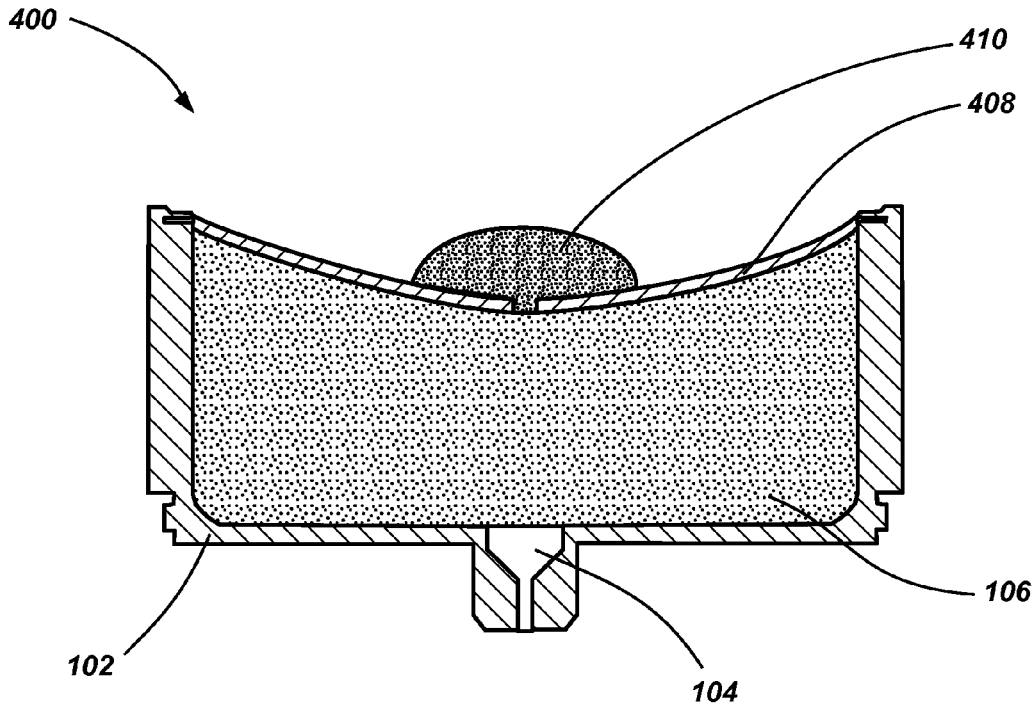
FIGS. 4A and 4B are, respectively, longitudinal cross-sectional views of a yet another embodiment of a device including a reactive material liner for generating an explosively formed projectile and an explosively formed projectile resulting from initiation of the device.
Figure 4B:
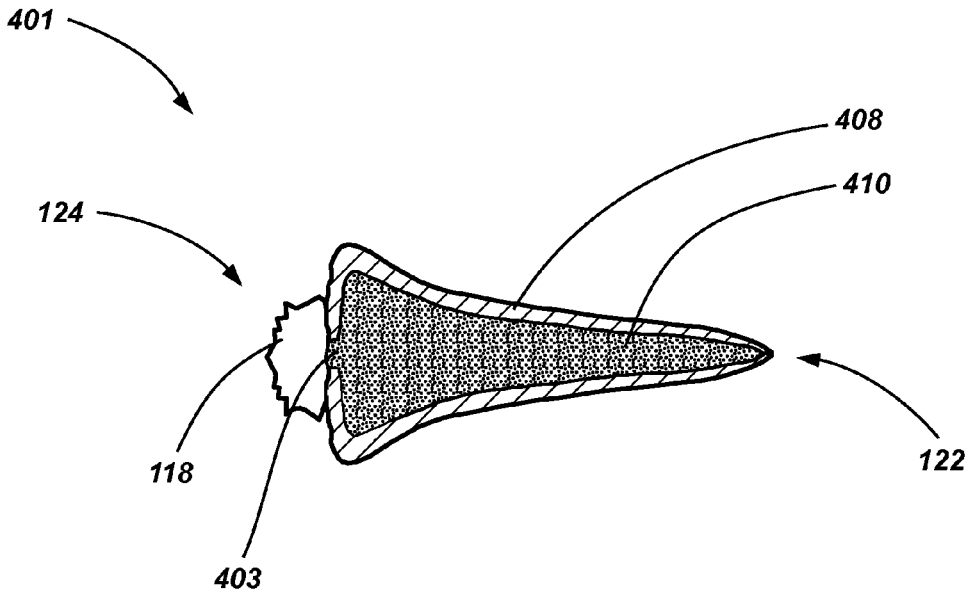

FIGS. 4A and 4B are, respectively, longitudinal cross-sectional views of a yet another embodiment of an EFP device 400 including a reactive material liner 410 for generating an explosively formed projectile 401 and an explosively formed projectile 401 resulting from initiation of the device 400. The EFP device 400 shown in FIG. 4A is substantially similar to the EFP device 100 previously described with reference to FIG. 1A, and may include a case 102, an initiator 104, an explosive material 106, and a primary liner 408. The primary liner 408 may be disposed on the forward surface of the explosive material 106 and the reactive material liner 410 may be disposed on the forward surface of the primary liner 408. The EFP device 400 may form the forward folding explosively formed projectile 401 (i.e., the primary liner 408 folds around the reactive material 410 toward the direction of projectile travel) shown in FIG. 4B. For example, after initiation of the explosive material 106, the primary liner 408 may form a posterior portion 124 of the projectile 401. The primary liner 410 may surround the reactive material 410 and the end portions of the primary liner 408 may form the anterior portion 122 of the projectile 401. A propulsive jet 118 of the reactive material liner 410 may be formed through a hole 403 in the primary liner 408.

The following examples serve to explain embodiments of the present invention in more detail. These examples are not to be construed as being exhaustive or exclusive, or otherwise limiting, as to the scope of this invention.

EXAMPLES

Example 1

Explosively Formed Projectile Testing Using a First Epoxy Based Reactive Material and a Stereolithographic Polymer A first velocity test was performed on an EFP device similar to the EFP device shown in FIG. 2. The testing assembly included an EFP device mounted on polystyrene foam blocks and an alloy steel plate (AR400) target located 10 feet (3.048 meters) from the EFP device. Two X-ray stations with film cassettes were located between the EFP device and the target to obtain the profile and velocity of the projectile formed by the EFP device in flight. The first X-ray station was located 4 feet (1.219 meters) from the EFP device and the second X-ray station was located 9 feet (2.743 meters) from the EFP device. A high-speed digital camera was located at the target to record the projectile impact.

The EFP device was fabricated from a modified Selectable Lightweight Attack Munitions (SLAM) warhead manufactured by the Alliant Techsystems (ATK) Corporation of Minneapolis, Minn. The explosive material and liners in the SLAM warhead included a LX-14 explosive material weighing 256.9 grams formed within the case. The SLAM warhead also consisted of a primary liner and a reactive material liner. The primary liner was formed from copper having a weight of 44 grams and an average axial thickness of 0.0366 inch (0.923 millimeter). The reactive material liner was formed from a first epoxy based reactive material having a weight of 44.6 grams, a density of 6.080 g/cc, and an average axial thickness of 0.0543 inch (1.379 millimeters). The first epoxy based reactive material comprised 71.434 percent by weight tungsten (about 50.004 percent tungsten having a particle size of about 90 μm and 21.430 percent tungsten having a particle size of about 6 to 8 μm), 9.988 percent by weight potassium perchlorate, about 9.988 percent by weight zirconium and 8.590 percent by weight of an epoxy material. The epoxy material included 4.419 percent by weight ARALDITE® LY 1556, 3.977 percent by weight ARADUR® 917, 0.023 percent by weight Accelerator DY 070 (each of which are commercially available from Huntsman Advanced Materials of Brewster, N.Y.), and 0.171 percent by weight cabosil. The control liner was formed from a sterolithographic polymer having a weight of 15.3 grams, a density of 1.12 g/cc, and an average axial thickness of 0.1000 inch (2.54 millimeters). In the test, the sterolithographic polymer was formed from a liquid photopolymer manufactured under the trade name WATERSHED™ 11120 and commercially available from the DMS SOMOS® Corporation of New Castle, Del.

The predicted velocity for the tested EFP projectile without any assist from the reactive material was 2.24 km/s. The measured velocity just prior to impact with the target measured with the high-speed digital camera was 2.68 km/s.

The results of the first velocity test on the projectile formed by the EFP device having a first epoxy based reactive material liner and a stereolithographic polymer control liner indicated that the projectile including the reactive material exhibited a velocity greater than the predicted velocity of the projectile.

Example 2

Explosively Formed Projectile Testing Using a Second Epoxy Based Reactive Material and a Stereolithographic Polymer A second velocity test was performed on an EFP device similar to the EFP device shown in FIG. 2. The testing assembly was similar to the test in Example 1 except an additional X-ray station located at the EFP device was added to obtain the profile and velocity of the projectile just after the projectile had been formed by the EFP device.

The EFP device was fabricated from a SLAM warhead that included a 256.9 gram LX-14 explosive material formed in the case, a primary liner, and a reactive material liner. The primary liner was formed from copper having a weight of 44 grams and an average axial thickness of 0.0366 inch (0.923 millimeter). The reactive material liner was formed from a second epoxy based reactive material having a weight of 47.6 grams, a density of 6.552 g/cc, and an average axial thickness of 0.0504 inch (1.280 millimeters). The second epoxy based reactive material comprised 72.112 percent by weight tungsten (50.478 percent tungsten having a particle size of about 90 μm and 21.634 percent tungsten having a particle size of about 6 to 8 μm), 10.000 percent by weight nickel, 10.000 percent by weight aluminum and 7.888 percent by weight of an epoxy material. The epoxy material included 4.088 percent by weight ARALDITE® LY 1556, 3.680 percent by weight ARADUR® 917, 0.021 percent by weight Accelerator DY 070 (each of which are commercially available from Huntsman Advanced Materials of Brewster, N.Y.), and 0.100 percent by weight cabosil. The control liner was formed from a sterolithographic polymer having a weight of 15.3 grams, a density of 1.12 g/cc, and an average axial thickness of 0.1000 inch (2.54 millimeters). In the test, the sterolithographic polymer was the same as the polymer used in Example 1.

The predicted velocity for the projectile formed by the EFP device without any assist from the reactive material is 2.19 km/s. The measured velocity just after formation of the projectile was approximately 2.20 km/s. The measured velocity at the first X-ray station was 2.72 km/s.

Similar to Example 1, the results of the second velocity test on the projectile formed by the EFP device having a second epoxy based reactive material liner and a stereolithographic polymer control liner indicated that the projectile including the reactive material exhibited a velocity greater than the predicted velocity of the projectile and exhibited a velocity greater than the measured velocity just after formation.

In view of the above, embodiments of the present invention may be particularly useful in producing EFPs enhanced by reactive materials. The ignition of the reactive material creating a propulsive jet may be used to increase the velocity of an EFP beyond the initial velocity produced by the ignition of the explosive material in the case. Conventionally, the amount of explosives in the case along with the material properties of the liners and case inhibit the amount of energy that may be delivered to the liners. The ability to increase the velocity of a projectile after the projectile has been formed with an initial velocity imparted by the explosive material will enable the projectile to obtain velocities not attainable previously in similar, but conventional, EFP device configurations. The higher velocity of the projectile may increase the range and destructive capability of the projectile such as perforation capability and the behind-armor debris effects. The ignition of the reactive material provides a relatively lower g-force acceleration of the projectile than the explosive material and may accelerate the projectile without substantially damaging or breaking up the formed projectile. Further, the combustion of the reactive material may provide a tracer effect on the projectile during its flight.

While the present invention has been described herein with respect to certain preferred embodiments, those of ordinary skill in the art will recognize and appreciate that it is not so limited. Rather, many additions, deletions and modifications to the preferred embodiments may be made without departing from the scope of the invention as hereinafter claimed, and legal equivalents. In addition, features from one embodiment may be combined with features of another embodiment while still being encompassed within the scope of the invention as contemplated by the inventors.

What is claimed is:

1. A liner assembly for use with a device for forming an explosively formed projectile, the liner assembly comprising:

a reactive material liner comprising a reactive material;

a primary liner configured to, upon initiation of an explosive material used to form an explosively formed projectile, deform into an outer portion of the projectile at least partially surrounding a portion of the reactive material liner and wherein at least a portion of the reactive material liner is configured and formulated to increase a velocity of the projectile in excess of a velocity generated by the explosive material; and a control liner comprising a control material, the control liner disposed on at least a portion of the reactive material liner and wherein the control liner is configured and formulated to, upon initiation of the explosive material used to form the explosively formed projectile, deform into a posterior portion of the projectile and to at least partially control a rate of reaction of an ignited portion of the reactive material liner.

2. The liner assembly of claim 1, wherein the primary liner is configured and formulated to, upon initiation of the explosive material used to form the explosively formed projectile, deform into a substantially elongated shaped outer portion of the projectile.

3. The liner assembly of claim 2, wherein the reactive material liner is configured and formulated to deform into a central portion of the projectile.

4. The liner assembly of claim 1, wherein the primary liner is disposed over at least a portion of the reactive material liner and wherein the primary liner and the reactive material liner are each formed to have a substantially curved shape.

5. The liner assembly of claim 1, wherein the primary liner comprises copper material.

6. The liner assembly of claim 5, wherein the reactive material liner comprises a metal material selected from at least one of tungsten, zirconium, aluminum, and nickel.

7. The liner assembly of claim 6, wherein the reactive material liner further comprises an oxidizer material selected from at least one of potassium perchlorate, potassium nitrate, ammonium perchlorate, and cupric oxide.

8. The liner assembly of claim 1, further comprising:

a buffer liner comprising a buffer material at least partially disposed on the reactive material liner and configured to, upon initiation of the explosive material used in the explosively formed projectile, deform into a central portion of the projectile; and an additional reactive material liner comprising an additional reactive material disposed on at least a portion of the buffer liner and configured and formulated to, upon initiation of the explosive material used to form the explosively formed projectile, deform into the central portion of the projectile and wherein the buffer liner is configured to at least partially separate the reactive material liner and the additional reactive material liner.

9. The liner assembly of claim 1, wherein at least a portion of the reactive material liner is configured and formulated to ignite when the reactive material liner is deformed.

10. The liner assembly of claim 9, wherein the primary liner is configured to deform into the outer portion of the projectile exposing a portion of the reactive material liner at a posterior end of the projectile.

11. The liner assembly of claim 10, wherein the reactive material liner is configured and formulated to form a propulsive jet created by the ignition of the reactive material liner to increase the velocity of the projectile.

12. An ordnance device for generating an explosively formed projectile comprising:

a case;

an explosive material at least partially disposed within the case;

a reactive material liner comprising a reactive material at least partially disposed within the case; and a primary liner at least partially disposed within the case and abutting at least a portion of a surface of the reactive material liner, the primary liner configured to deform into an outer portion of a projectile at least partially surrounding a portion of the reactive material liner responsive to initiation of the explosive material, and wherein at least a portion of the reactive material liner is configured and formulated to increase a velocity of the projectile in excess of a velocity generated by the explosive material after the projectile has been expelled from the case.

13. The ordnance device of claim 12, wherein the explosive material is configured and formulated to propel the projectile formed by the reactive material liner and the primary liner from the case at a first initial velocity and a portion of the reactive material liner is configured and formulated to accelerate the projectile to a second, increased velocity.

14. The ordnance device of claim 13, wherein the second, increased velocity is at least 10% greater than the first initial velocity.

15. The ordnance device of claim 12, wherein at least a portion of the reactive material liner is configured and formulated to ignite upon being explosively expelled from the case.

16. The ordnance device of claim 12, further comprising a control liner comprising a control material, the control liner at least partially disposed within the case and at least partially disposed between the reactive material liner and the explosive material and wherein the control liner is configured to deform into a posterior portion of the projectile after being explosively expelled from the case and to at least partially control a rate of reaction of a portion of the reactive material liner.

17. An explosively formed projectile comprising:

a deformed primary liner substantially forming an outer portion of the projectile; and a deformed reactive material liner at least partially disposed within the deformed primary liner and wherein an ignited portion of the deformed reactive material liner increases a velocity of the projectile in excess of a velocity generated by an explosive material used to form the projectile.

18. The explosively formed projectile of claim 17, wherein the deformed reactive material liner forms a portion of a central portion of the projectile.

19. The explosively formed projectile of claim 18, further comprising a deformed control liner forming a posterior portion of the projectile and at least partially surrounding a portion of the deformed reactive material liner, the deformed control liner at least partially controlling a rate of reaction of the ignited portion of the deformed reactive material liner.

20. The explosively formed projectile of claim 19, further comprising:

a deformed buffer liner forming at least a portion of the central portion of the projectile; and an additional deformed reactive material liner forming at least a portion of an anterior portion of the projectile, wherein the deformed buffer liner at least partially separates the deformed reactive material liner and the additional deformed reactive material liner.

21. A method of explosively forming a projectile with the liner assembly of claim 1, the method comprising:

explosively expelling the primary liner and the reactive material liner from a case;

deforming the primary liner to at least partially surround a portion of the reactive material liner; and increasing a velocity of the projectile by combusting at least a portion of the reactive material liner.

22. The method of claim 21, further comprising igniting a portion of the reactive material liner as the reactive material liner is explosively expelled from the case.

* * * * *

UNITED STATES PATENT AND TRADEMARK OFFICE

CERTIFICATE OF CORRECTION

PATENT NO. : 8,443,731 B1
APPLICATION NO. : 12/510017
DATED : May 21, 2013
INVENTOR(S) : Frederick P. Stecher and Richard M. Truitt It is certified that error appears in the above-identified patent and that said Letters Patent is hereby corrected as shown below:

In the specification:

| | | |
|---|---|---|
| COLUMN 2, | LINE 58, | change "a explosively" to --an explosively-- |
| COLUMN 2, | LINE 63, | change "after the forming" to --after the-- |
| COLUMN 3, | LINE 24, | change "of an another" to --of another-- |
| COLUMN 3, | LINE 29, | change "of an another" to --of another-- |
| COLUMN 3, | LINE 35, | change "of a yet another" to --of yet another-- |
| COLUMN 3, | LINE 57, | change "cylindrical tube;" to --cylindrical tube,-- |
| COLUMN 6, | LINE 22, | change "2006;" to --2006, now U.S. Patent 8,122,833, issued February 28, 2012;-- |
| COLUMN 6, | LINE 27, | change "2007;" to --2007, now U.S. Patent 8,075,715, issued December 13, 2011;-- |
| COLUMN 6, | LINE 31, | change "2007;" to --2007, now U.S. Patent 7,977,420, issued July 12, 2011;-- |
| COLUMN 11, | LINE 52, | change "liner **308**," to --liner **308** and-- |
| COLUMN 12, | LINE 44, | change "FIG. **2**." to --FIG. **2A**.-- |
| COLUMN 13, | LINE 18, | change "DMS SOMOS® Corporation" to --DSM Desotech Inc.-- |
| COLUMN 13, | LINE 36, | change "FIG. **2**." to --FIG. **2A**.-- |

Signed and Sealed this
Fourteenth Day of July, 2015

Michelle K. Lee

Michelle K. Lee
*Director of the United States Patent and Trademark Office*